US005893172A

United States Patent [19]

Haynes et al.

[11] Patent Number: 5,893,172

[45] Date of Patent: Apr. 13, 1999

[54] GOLF GLOVES HAVING FLEXIBLE KNUCKLES

[76] Inventors: Michael J. Haynes, 2285 Rutherford Rd., Carlsbad, Calif. 92008; Hyo B. Park, 3592 Runningtide Cir., Huntington Beach, Calif. 92649-2514

[21] Appl. No.: 08/924,748

[22] Filed: Sep. 5, 1997

[51] Int. Cl.[6] ..... A41D 19/00

[52] U.S. Cl. ..... 2/161.2; 2/159; 2/167

[58] Field of Search ..... 2/159, 161.1, 161.2, 2/161.3, 161.4, 167

[56] References Cited

U.S. PATENT DOCUMENTS

| | | | |
|---|---|---|---|
| D. 340,793 | 11/1993 | Autier | D2/619 |
| 3,123,832 | 3/1964 | Kubik | 2/161.1 |
| 4,911,433 | 3/1990 | Walker et al. | 2/161.1 |
| 5,195,188 | 3/1993 | Bourdeau et al. | 2/161.1 |
| 5,708,979 | 1/1998 | Redwood et al. | 2/161.1 |

*Primary Examiner*—Michael A. Neas

*Attorney, Agent, or Firm*—John K. Park; Law Offices of John K. Park & Associates

[57] ABSTRACT

A glove, preferably for use by a golfer, including a front section, a back section, and a flexible knuckle section. The front section comprises a substantially inelastic material having good gripping qualities that substantially covers the palm, the front of the thumb and the front of the fingers. The back section comprises a substantially inelastic material having good gripping qualities that substantially covers the back of the hand, and preferably the back of the index finger and back of the thumb. The knuckle section comprises a substantially stretchable, resilient material that substantially covers a knuckle of the middle, ring, and/or little fingers. Preferably, the knuckle section covers the top knuckle of the ring and little fingers, thereby providing a comfortable, flexible glove that does not interfere with the golfer's grip on a golf club.

19 Claims, 3 Drawing Sheets

GOLF GLOVES HAVING FLEXIBLE KNUCKLES

FIELD OF THE INVENTION

The present invention relates generally to gloves, and more particularly to a golf glove having substantially stretchable fabric at least partially covering the knuckles of the hand.

BACKGROUND

Golfers may typically wear a glove on one hand to give them better control of and grip on their golf club, as well as to protect their hand. Conventional golf gloves are generally manufactured from leather or synthetic materials, providing desired gripping qualities that substantially minimize slippage of the club during use.

Because leather and similar materials are substantially inelastic, however, they may not provide the most comfortable fit. Generally, a golfer's hand is inserted into a glove with the hand and fingers fully extended. Fasteners or snaps typically included on the back of the glove are then drawn tight and fixed. When the golfer subsequently grips a club, the hand is wrapped around the shaft, drawing the back of the glove tight as the fingers are bent. This tension imposes pressure on the knuckles of the hand, creating discomfort which may distract the golfer.

Stretchable, elastic materials may be substituted for the leather-like materials, but they are generally slippery and provide poor gripping qualities. In addition, many golfers use an interlocking grip when grasping a club whereby fingers from one hand interlock with those of the other. Use of such a grip may cause the fingers of one hand to overlap the back of the other hand. Providing a different material for the back of the glove presents the golfer who uses such a grip with an unusual texture or slippery surface which may distract him or her during play.

Thus, there is a need for a golf glove that provides improved comfort without substantially compromising the desired gripping qualities of the glove.

SUMMARY OF THE INVENTION

The present invention is directed to a golf glove having stretchable fabric substantially covering at least some of the knuckles on the middle, and/or ring, and/or little fingers that provides improved comfort for the golfer while not substantially interfering with the feel of the golfer's grip on a golf club. A single glove is generally provided, for the left hand of a right-handed golfer or for the right hand of a left-handed golfer, although alternatively, a pair of gloves may be provided, if a golfer also wishes to cover his or her dominant (i.e. other) hand.

Generally the glove of the present invention comprises a front section, a back section, and a knuckle section that are preferably stitched together to form the glove. The front section generally covers the palm and the front of the fingers and thumb of the golfer's hand, and generally comprises conventional materials providing desired gripping and protective qualities, such as leather or synthetic materials, such as polyurethane. The back section substantially covers the back of the hand, and generally also comprises similar materials. Preferably, the back section also covers the back of the index finger and the thumb, and the backs of the other fingers except the knuckle section as is explained below.

The knuckle section of the glove preferably covers one or more knuckles of the hand, and comprises a substantially flexible, resilient material, such as a nylon-based fabric, and more preferably a substantially elastic material, such as that available under the brand name Lycra®. In a preferred embodiment, the knuckle section covers the top knuckles of the little finger and the ring finger. Alternatively, the knuckles of any one, two or all three of these fingers may be covered by the knuckle section, depending upon the comfort and fit desired for the glove. The knuckle section typically extends partially down the finger(s), and preferably substantially covers the middle knuckle(s).

Preferably, the knuckle section is stitched to the back section, which is stitched to the front section with one or more fourchettes provided between the fingers. The seams between the fourchettes and the knuckle section preferably extend along the back surface of the fingers and knuckles, away from the area between the fingers, thereby preventing the seams from creating an uncomfortable feel between the fingers. Thus, the knuckle section provides fabric covering the knuckles which stretches when the hand grips a club, thereby substantially reducing pressure on the knuckles and creating a more comfortable fit.

In addition, because the index finger and thumb preferably are included in the back section and are made of back section materials, the knuckle section of the glove does not substantially interfere with a golfer's interlocking grip. In an interlocking grip, the little finger of the golfer's dominant hand interlocks between the index and middle fingers of the golfer's gloved hand, and contacts the knuckle of the index finger of the golfer's gloved hand. The dominant hand then wraps around the golf club and the thumb of the gloved hand. With the glove of the present invention, the little finger of the dominant hand contacts the back section covering the knuckle of the index finger, and the dominant hand wraps around the back section material covering the thumb. Thus, both the little finger and the entire dominant hand engage a gripping surface (e.g. leather) rather than a potentially slippery surface (e.g. Lycra®, such as that of the knuckle section) which may create a tactile distraction.

Therefore, it is a principal object of the present invention to provide an improved comfort golf glove that does not substantially interfere with the golfer's grip or create a tactile distraction.

Other objects and features of the present invention will become apparent from consideration of the following description taken in conjunction with the accompanying drawings.

BRIEF DESCRIPTION OF THE DRAWINGS

For a better understanding of the invention, and to show how it may be carried into effect, reference will be made, by way of example, to the accompanying drawings, in which.

DETAILED DESCRIPTION OF THE PREFERRED EMBODIMENTS

Figure 1:
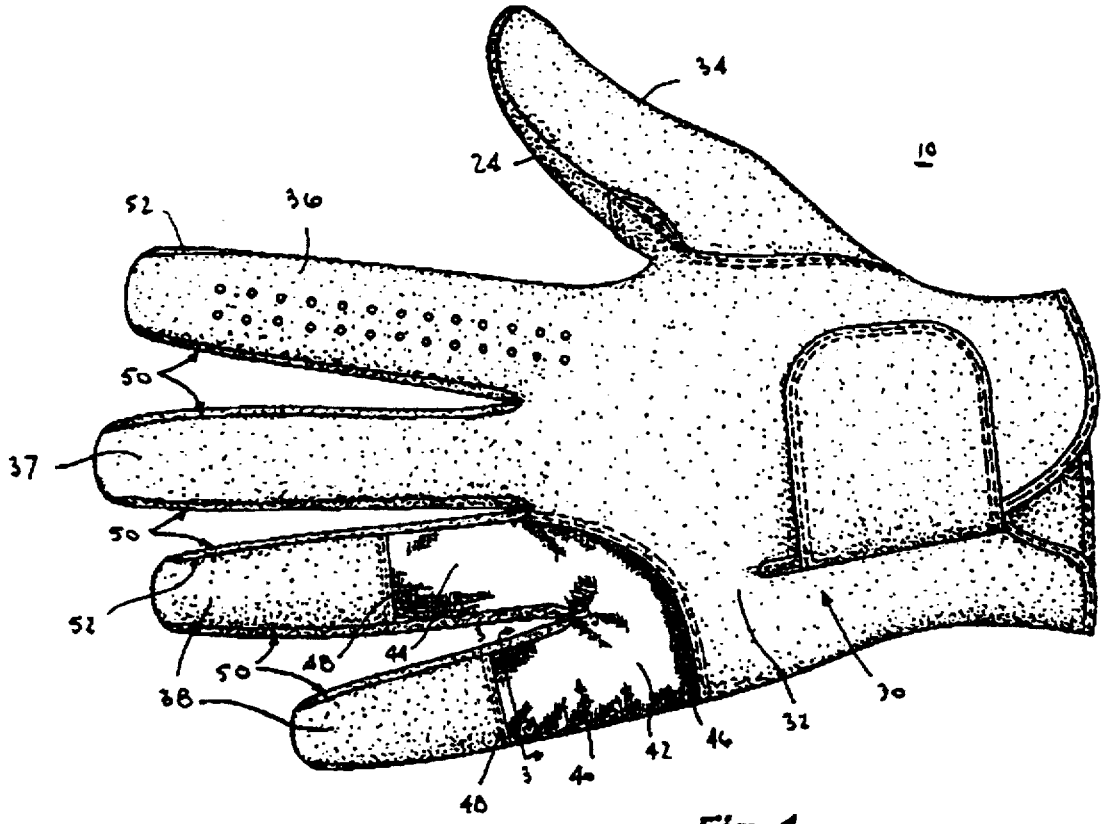
FIG. 1 is a top view of the back side of a preferred embodiment of the glove of the present invention, showing the flexible knuckle section.
Figure 2:
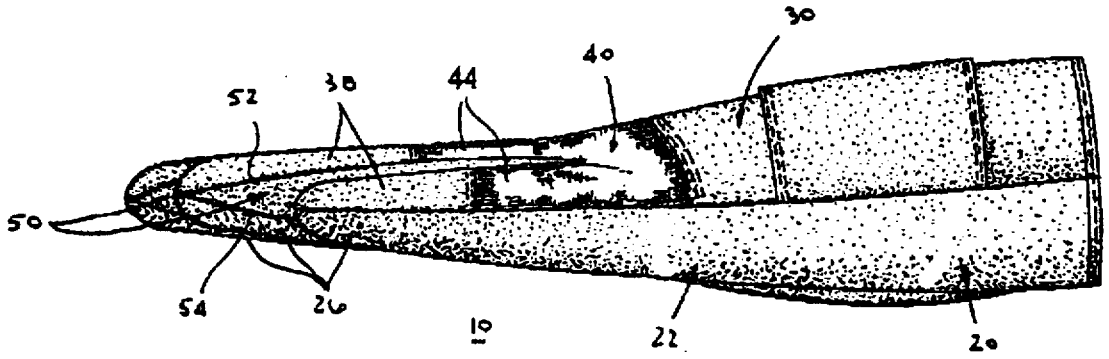
FIG. 2 is a side view of the glove of FIG. 1.

Referring to FIGS. 1 and 2, a preferred embodiment of the present invention is shown, namely a glove 10 for the left hand of a right-handed golfer, although alternatively, a glove for the right hand of a left-handed golfer may be provided, or a pair of gloves may be provided. In addition, the glove is typically available in a variety of sizes for different sized hands.

The glove 10 generally comprises a front section 20, a back section 30, and a knuckle section 40. The front section 20 comprises a panel of material including a palm region 22, a thumb region 24, and four finger regions 26. The back section 30 comprises a panel of material including a hand region 32, a thumb region 34, and an index finger region 36. The back section 30 also includes one or more finger tip regions 38, each typically provided as a separate panel of material for each finger included in the knuckle section 40. In addition, the back section 30 may include additional finger regions 37, depending upon the number of fingers covered by the knuckle section 40. For example, in the preferred embodiment shown in FIG. 1, the back section 30 includes a finger region 37 covering the middle finger.

Figure 4:
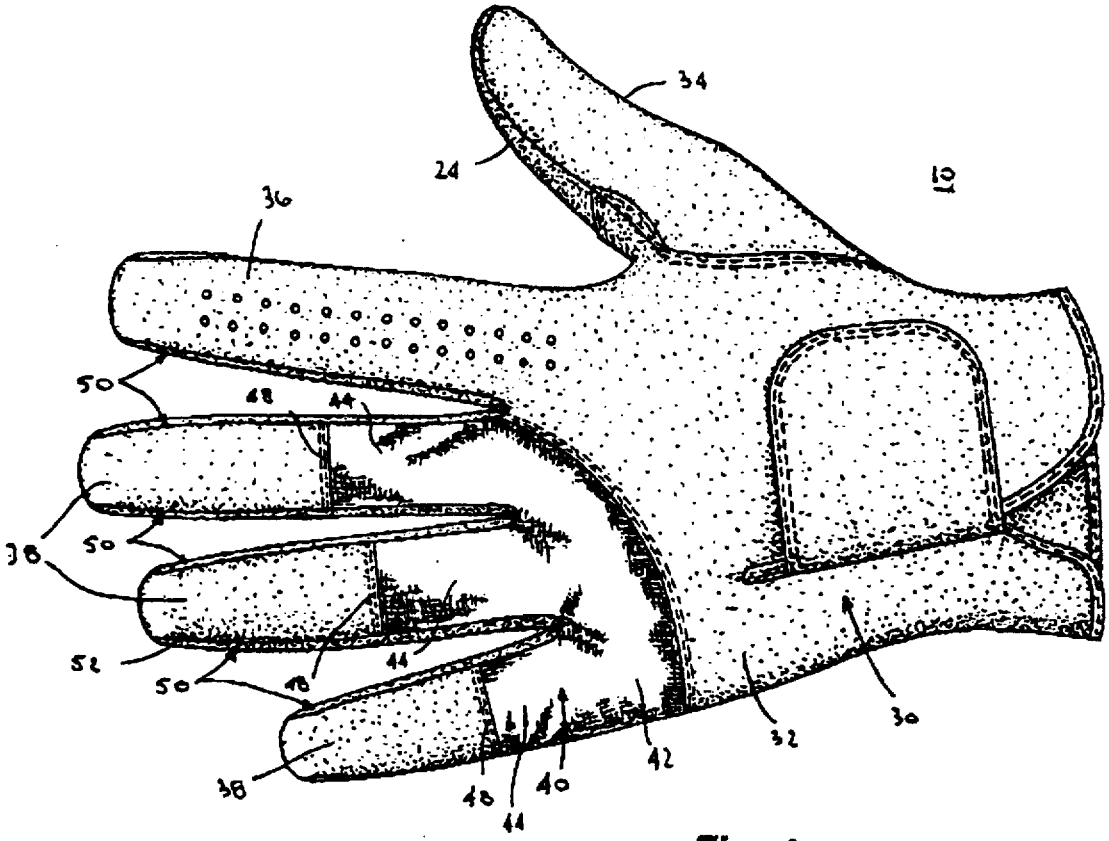
FIG. 4 is a top view of the back side of the glove, showing an alternative embodiment of the knuckle section.
Figure 5:
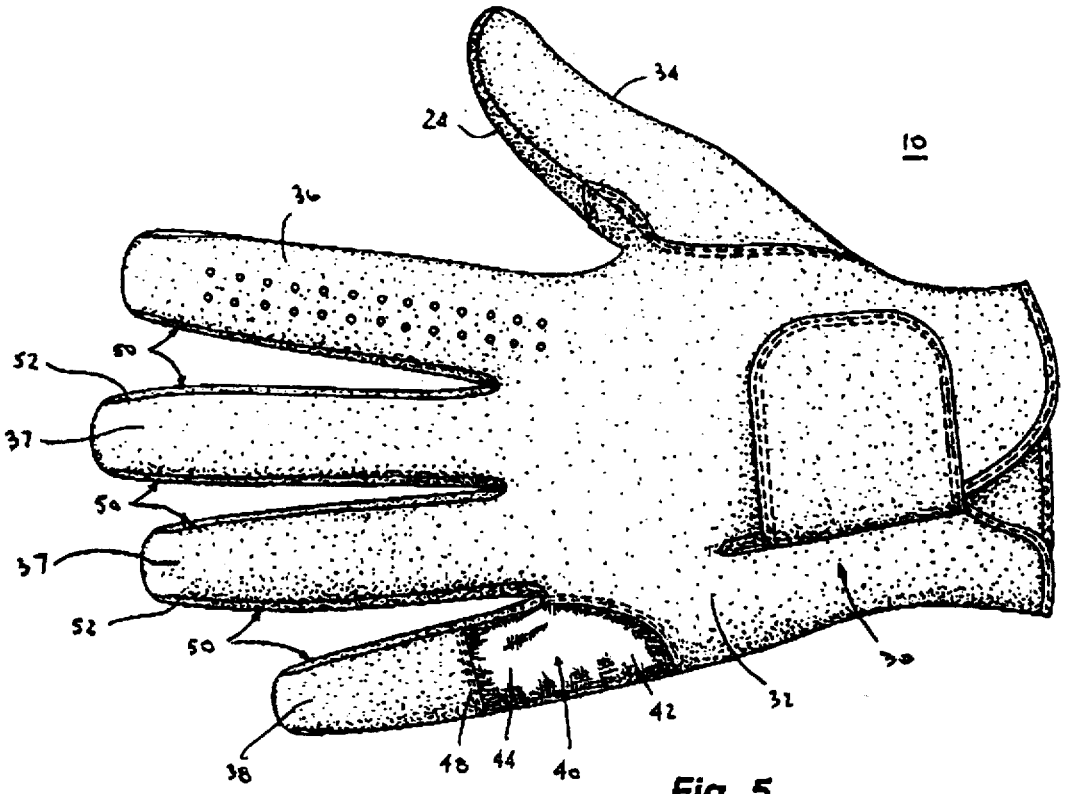
FIG. 5 is a top view of the back side of the glove, showing another alternative embodiment of the knuckle section.

The knuckle section 40 comprises a panel of material which includes a knuckle region 42, and one or more finger regions 44, and is preferably furnished as a single piece of fabric. Preferably, the knuckle section 40 substantially covers the top knuckle of the little and ring fingers, as shown in FIG. 1. Alternatively, depending upon the fit and comfort desired, possibly one, two or all three of these fingers may be covered. For example, FIG. 4 shows a second preferred embodiment in which the knuckle section covers the top knuckles of the little, ring, and middle fingers. FIG. 5 shows a third preferred embodiment of the glove 10 which has a knuckle section 40 that covers the top knuckle of the little finger. Generally, the finger region(s) 44 of the knuckle section 40 extend partially down the back of the covered fingers, preferably substantially covering the middle knuckle of the finger(s) desired.

Generally, one or more fourchettes 50 are sewn, preferably by conventional stitching, between the fingers of the glove 10, thereby attaching the front section 20 to the back section 30 and the knuckle section 40, and defining finger stalls of the glove 10. Preferably, an elongate triangular fourchette 50 is provided between the fingers on each side of the adjacent finger stalls with the apex located adjacent the finger tip of the respective stall. The other ends of the fourchettes are preferably not sewn together, thereby providing a hole between the fingers allowing the glove to breathe. Alternatively, a fourchette may be provided that covers the region between two adjacent fingers from one finger tip to the adjacent finger tip, or a single long fourchette may be provided for the entire glove.

In assembling the glove 10, the knuckle region 42 of the knuckle section 40 and the hand section 32 of the back section 30 are sewn together along seams 46. The finger tip regions 38 of the back section 30 and the finger regions 44 of the knuckle section 40 are sewn together along seams 48. The fourchettes 50 and the finger tip regions 38, the index finger region 36, and the finger regions 44 are sewn together along seam 52. The fourchettes 50 and the finger sections 26 of the front section 20 are sewn together along seam 54. The stalls for receiving the fingers of the hand therein are thereby created.

Alternatively, the glove 10 is provided without fourchettes, using a "gun cut" construction. Instead of the fourchettes, extra material may be provided an the front section 20, the back section 30 or some combination thereof to form the sides of the finger stalls. As is understood by those within the industry, the common method of accomplishing this is to extend the material of the back section. Gun cut construction is less expensive to manufacture as the amount of sewing is reduced with the elimination of seams 52 and 54, and the creation of a single new seam (not shown). Gun cut constructions, however, provides a less comfortable fit for a glove, and so the glove 10 including fourchettes 50 is generally preferred.

The materials of the front section 20, the back section 30, and the fourchettes 50 are conventional and should be known to those reasonably skilled in the art. They are generally substantially inelastic materials that protect the golfer's hand while providing a good gripping surface for holding a club. For example, leather or synthetic materials are commonly used, with hairsheep skin or Cabretta leather, or polyurethane being most preferred. For example, in the preferred embodiments, the front and back sections are provided entirely from Cabretta leather, or entirely from polyurethane, or the front section is provided from Cabretta leather while the back section is provided from polyurethane.

The panels may comprise a plurality of partial panels sewn together or a single peel of material. Furthermore, one or more additional layers of leather or synthetic material may be sewn onto areas that are exposed to greater wear and tear, such as the thumb and/or the palm of the glove, thereby reinforcing those areas. The glove may also include additional stitching for improved fit and/or comfort, embroidered or printed designs, decorative accessories such as buttons, openings for allowing the glove to breathe, and/or fasteners or snaps to ease putting on and removing the glove, as will be known to those familiar with the manufacture of golf gloves.

The material for the knuckle section 40 generally comprises a substantially flexible fabric, preferably a single piece of fabric, that stretches when the hand is bent or flexed, and that is substantially resilient thereby substantially returning to its original unstretched form when the hand is relaxed or the glove is removed. Exemplary materials include any nylon-based stretchable fabric, although fabric available under the trademark Lycra® is most preferred. Thus, the material of the knuckle section 40 allows the glove to elastically give when the hand is closed, as opposed to the substantially inelastic materials used for conventional golf gloves, thereby providing improved comfort and flexibility.

An important feature of the present invention is that the knuckle region preferably covers at most only the middle, ring and/or little fingers. Preferably, the index finger region 36 and the thumb region 34, as part of the back section 30, are provided from conventional materials, such as leather, such that when the dominant hand is interlocked with the gloved hand, the dominant hand engages leather, rather than the elastic material used for the knuckle section 40. This allows a secure interlocking grip to be maintained and substantially eliminates any tactile distraction likely to occur if the slippery fabric of the knuckle section or a seam were contacted instead.

Figure 3:
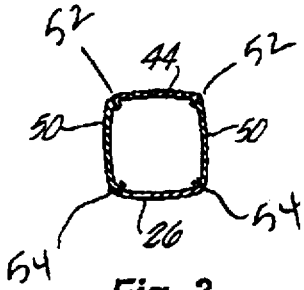
FIG. 3 is a cross-section through a finger of the glove long line 3—3 of FIG. 1.

Another important feature of the present invention is the seam 52 connecting the knuckle section 40 to the fourchettes 50. As shown in FIG. 3, the seam 52 preferably extends along the back surface of the fingers and around the knuckle, keeping the seam 52 away from the area between the fingers where it can cause discomfort.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A golf glove comprising a front section comprising a substantially inelastic material substantially covering the front of a hand fully inserted into the glove, a back section comprising a substantially inelastic material substantially covering the back of the hand, and the knuckles of the index finger of the hand, and a knuckle section comprising a substantially elastic material covering a top knuckle of at least one of the other fingers of the hand.

2. The golf glove of claim 1 wherein said back section substantially covers the index finger of the hand.

3. The golf glove of claim 1 wherein said back section substantially covers the thumb of the hand.

4. The golf glove of claim 1 wherein said front and back sections comprise leather.

5. The golf glove of claim 1 wherein said front and back sections comprise polyurethane.

6. The golf glove of claim 1 wherein said front section comprises leather and said back section comprises polyurethane.

7. The golf glove of claim 1 wherein said knuckle section covers the top knuckle of the little finger of the hand.

8. The golf glove of claim 1 wherein said knuckle section covers the top knuckle of the ring finger of the hand.

9. The golf glove of claim 1 wherein said knuckle section covers the top knuckle of the middle finger of the hand.

10. The golf glove of claim 1 wherein said knuckle section covers the top knuckles of the little and ring fingers of the hand.

11. The golf glove of claim 1 wherein said knuckle section covers the top knuckles of the little and middle fingers of the hand.

12. The golf glove of claim 1 wherein said knuckle section covers the top knuckles of the ring and middle fingers of the hand.

13. The golf glove of claim 1 wherein said knuckle section covers the top knuckles of the little, ring and middle fingers of the hand.

14. The golf glove of claim 1 wherein said knuckle section comprises a nylon-based fabric.

15. The golf glove of claim 1 further comprising one or more fourchettes connecting said knuckle section to said front section.

16. The golf glove of claim 15 further comprising a seam between said one or more fourchettes and said knuckle section, said seam extending substantially along the back of a finger covered by said knuckle section.

17. The golf glove of claim 1 further comprising a plurality of seams, said seams attaching said front, back and knuckle sections together, said seams being located substantially away from the area between the fingers of the glove.

18. A golf glove comprising a front section comprising a substantially inelastic material substantially covering the front of a hand fully inserted into the glove, a back section comprising a substantially inelastic material substantially covering the back of the hand, and the knuckles of the index finger of the hand, and a knuckle section comprising a substantially elastic material covering the top knuckle of one of the other fingers of the hand, said knuckle section extending partially down the back of the finger corresponding to the knuckle covered by said knuckle section.

19. The golf glove of claim 18 wherein said knuckle section substantially covers the top knuckles of the ring and little fingers of the hand, and said knuckle section extends partially down the back of the ring and little fingers of the hand.

* * * * *